US005737942A

United States Patent [19]

Gutschmit

[11] Patent Number: 5,737,942

[45] Date of Patent: Apr. 14, 1998

[54] MEANS FOR DETERRING LINT AND DEBRIS ACCUMULATION ON THE KNITTING ELEMENTS OF A CIRCULAR KNITTING MACHINE

[75] Inventor: Alan Gutschmit, Troy, N.C.

[73] Assignee: Alandale Industries, Inc., Troy, N.C.

[21] Appl. No.: 674,625

[22] Filed: Jul. 3, 1996

[51] Int. Cl.[6] ..... D04B 35/32

[52] U.S. Cl. ..... 66/168; 15/301

[58] Field of Search ..... 66/168; 15/301, 15/316.1, 345

[56] References Cited

U.S. PATENT DOCUMENTS

| | | | |
|---|---|---|---|
| 1,987,582 | 10/1935 | Terrell . | |
| 2,063,873 | 12/1936 | Hodge . | |
| 2,063,874 | 12/1936 | Hodge . | |
| 2,976,557 | 3/1961 | King, Jr. . | |
| 3,220,223 | 11/1965 | Schmidt | 66/168 |
| 3,274,803 | 9/1966 | Schmidt | 66/168 |
| 3,378,998 | 4/1968 | Shackelford | 66/168 X |
| 3,459,010 | 8/1969 | Ferri . | |
| 3,535,895 | 10/1970 | Krauss | 66/168 |
| 3,545,029 | 12/1970 | Walmsley et al. . | |
| 3,571,840 | 3/1971 | Gleaton et al. . | |
| 3,964,123 | 6/1976 | Pettersson . | |
| 4,505,136 | 3/1985 | Tsay . | |
| 4,691,536 | 9/1987 | Yorisue et al. . | |
| 4,703,632 | 11/1987 | Izumi et al. . | |

(List continued on next page.)

FOREIGN PATENT DOCUMENTS

| | | |
|---|---|---|
| 1 216 120 | 4/1960 | Germany . |
| 1 585 177 | 10/1970 | Germany . |
| 27 08 436 B1 | 7/1978 | Germany . |

OTHER PUBLICATIONS

Trevor Little, et al, "Latch Needle Wear With Open End Cotton Yarn," America's Textiles Int'l, Sep. 1986, pp. 109–110.

Monarch Knitting Machinery (U.K.) Ltd., "Special Notice," undated (indicated to be dated 1990 or earlier).

National Knitwear Manufacturers Association memorandum, Jun. 1, 1992, including paper entitled "Circular Knitting With Open End Yarns."

Groz–Beckert, Albstadt, Germany, The Influence of Spun Yarns on Needle Life, copyright Sep. 1995.

Groz–Beckert, Albstadt, Germany, "For High and Extreme Degrees of Stress: Groz–Beckert–Precision Needles Go and Goo," copyright 1995.

Groz–Beckert, Albstadt, Germany, "Conical Needle Hooks: Another Pioneering Development from Groz–Beckert," copyright Sep. 1995.

Groz–Beckert, Albstadt, Germany, "Groz–Beckert High–Performance Plastic–Filled Needle: Prevent Dirt Build–Up," copyright 1995.

Groz–Beckert, Albstadt, Germany, "Innovative Latch Needles with Welded Axle Bearings for Even Greater Stability and Less Wear," copyright 1995.

Groz–Beckert, Albstadt, Germany, "Needle Comparison — Needles for Vanguard 1SU4, 19–24 CUT GB VO 84.48 G0019, Exeltor 7134/094, Sugiura VO 84.48 T09 STL," Oct. 11, 1995.

*Primary Examiner*—John J. Calvert

*Attorney, Agent, or Firm*—Kennedy Covington; Lobdell & Hickman, LLP

[57] ABSTRACT

The accumulation of lint, debris and other contaminants in the needle and dial slots of a circular knitting machine can be significantly reduced by enclosing an annular air chamber spanning between the cylinder and dial and delivering a pressurized airstream into the chamber. The airstream can necessarily escape from the chamber only upwardly through the spacing between the cylinder and dial where the airstream serves to blow lint, debris and contaminants away from the critical knitting elements (e.g., needles and sinkers) and prevent the accumulation of such materials within the cylinder and dial slots. The conventional need for flushing the cylinder slots can be reduced or eliminated.

41 Claims, 2 Drawing Sheets

U.S. PATENT DOCUMENTS 4,718,253 1/1988 Lonati .
4,843,843 7/1989 Rovinsky .
4,869,080 9/1989 Rovinsky et al. .
5,175,905 1/1993 Gutschmit .
5,177,985 1/1993 Igarashi et al. .
5,195,337 3/1993 Gutschmit .
5,201,793 4/1993 Izumi et al. .
5,282,372 2/1994 Gutschmit .
5,323,509 6/1994 Igarashi et al. .
5,373,711 12/1994 Takemoto et al. .
5,379,614 1/1995 Igarashi .
5,408,850 4/1995 Kawase et al. .
5,437,732 8/1995 Igarashi et al. .
5,469,718 11/1995 Gutschmit .
5,497,531 3/1996 Kuhrau et al. .

MEANS FOR DETERRING LINT AND DEBRIS ACCUMULATION ON THE KNITTING ELEMENTS OF A CIRCULAR KNITTING MACHINE

BACKGROUND OF THE INVENTION

The present invention relates generally to circular knitting and, more particularly, to the deterrence and prevention of lint and debris accumulation in the area of the knitting elements of such circular knitting machines.

One of the principal problems and concerns which has historically plagued the textile industry is the generation of lint and debris inherently caused by the handling and manipulation of textile yarns and fibers at virtually all stages of textile yarn and fabric forming operations. Such problems are particularly acute in the production and handling of natural fibers such as cotton which characteristically contain dust, debris, foreign matter and like contaminants and moreover are by nature subject to the release of fibrous lint when handled. The growing popularity and usage of open-end spun yarns has contributed to these problems because such yarns commonly contain a somewhat higher content of contaminants than do ring-spun yarns. Such lint, debris and other contaminants, once released from the yarns and constituent fibers, tend to become airborne and ultimately settle on the textile producing equipment. If not removed, the progressive accumulation of such lint and debris will result in a gradual decrease in the quality of the textile fabric being produced and will negatively affect the proper operation and efficiency of the equipment, ultimately resulting in equipment damage or failure.

For example, in circular knitting machines, the lint, debris and other contaminants naturally released during the normal manipulation of the yarns being knitted tends to settle into the slots of the needle cylinder and the associated dial, contributing significantly to the wearing of the needles and sinkers, or other knitting elements, and can significantly accelerate the wear of these elements. Various techniques and devices have been developed over the years to address these problems, but only with typically modest levels of success and also with attendant disadvantages. For example, conventional circular knitting machines are routinely equipped with fans and other air blowing devices of differing sorts, intended to slow the accumulation of lint and debris onto the exposed surfaces of the machines. Such devices, however, do not prevent lint accumulation and, more importantly, have limited impact on deterring or slowing the accumulation of lint and debris in the critical area of the cylinder and dial slots.

Hence, it is also commonplace conventionally to equip circular knitting machines with so-called flushing devices which are periodically actuated, typically at the completion of a roll of fabric, to deliver a quantity of lubricating oil into the cylinder slots (and in some cases also into the dial slots) to flush away accumulated lint and debris while at the same time contributing to lubrication of the knitting elements. While such flushing operations are reasonably effective for their intended purpose, flushing operations do not address the root problem of deterring or preventing lint and debris accumulation. Also, flushing operations have the distinct disadvantage of soiling a portion of the fabric, necessitating that some quantity of the fabric be discarded as waste. Also, the need to periodically flush the knitting machine slots with oil contributes to the cost of operation of the machines.

SUMMARY OF THE INVENTION

It is accordingly a fundamental object of the present invention to provide a means of deterring, and hopefully largely preventing, the initial accumulation of lint, debris and other contaminants in the critical area of the knitting elements of a circular knitting machine, specifically, within the needle slots and also within the dial slots. An ancillary object of the invention is to reduce and possibly eliminate the need to flush the cylinder and dial slots with oil. Ultimately, the object of the present invention is to extend the useful life of the knitting elements of circular knitting machines, improve the efficiency of such machines, and reduce the attendant costs of operating such machines.

Briefly summarized, the present invention contemplates that these objects can be achieved by equipping a circular knitting machine with a means by which a pressurized airstream can be directed to flow through the annular spacing between the cylinder and dial of such machines. More particularly, the present invention is expected to be applicable to essentially any circular knitting machine of the type having a cylinder and a concentric dial supported for unitary rotation on a stationary frame. Fundamentally, the present invention provides a means mounted to the frame for defining an air chamber spanning between the cylinder and the dial in communication with the annular spacing therebetween and an associated means for delivering a pressurized airstream into the chamber to escape outwardly therefrom through the annular spacing, thereby to deter accumulation of lint and debris on the cylinder and the dial in such area.

As will be recognized by persons skilled in the art, such circular knitting machines have the cylinder oriented in an upright disposition with the dial located radially outwardly of the cylinder such that the cylinder and dial rotate unitarily about a substantially vertical axis. The machine frame characteristically supports an annular arrangement of needle cams outwardly about the cylinder on an annular frame element or surface and, spaced thereabove, has another annular frame element, typically in the form of a ring, supporting an annular arrangement of dial cams concentric to and radially outwardly about the cylinder. Such frame elements enable the air chamber to be conveniently created by providing an annular wall extending about the circular knitting machine vertically between the two annular frame elements so as to define the annular air chamber outwardly of the needle cams and beneath the dial and dial cams. As will be understood, the knitting interaction between the needles of the cylinder and the sinkers or other dial elements in the dial occurs at the area of the annular spacing. Hence, the air flow of the pressurized air delivered into the chamber escaping upwardly through the annular spacing serves throughout the knitting operation to substantially counteract any tendency of lint, debris and other contaminants to settle into the cylinder and dial slots with considerably greater effectiveness than conventional fans, air blowing devices and flushing equipment.

Preferably, the annular wall defining the air chamber is fabricated of a series of adjoining wall elements, at least some of which are slidable or otherwise movable to provide open access to the cylinder and the dial as may be needed, for example, for servicing. It is also preferred that the pressurized airstream be delivered into the chamber at plural annular locations thereabout to promote uniform pressurization throughout the entire annular extent of the chamber and, in turn, a uniform annular air flow upwardly through the spacing between the cylinder and the dial. The airstream can be created in any conventional manner, one simple and effective means being the use of a centrifugal air pump drawing air from the ambient environment about the knitting machine. To ensure that the airstream is substantially clean, i.e., generally free of lint, debris and contaminants, so as not to contribute to the problem sought to be avoided, the intake to the pump preferably is equipped with a filter bag to remove such materials from the air. Optimally, the fan or other airstream generating device is operated continuously throughout the operation of the knitting machine.

DETAILED DESCRIPTION OF THE PREFERRED EMBODIMENT

Figure 1:
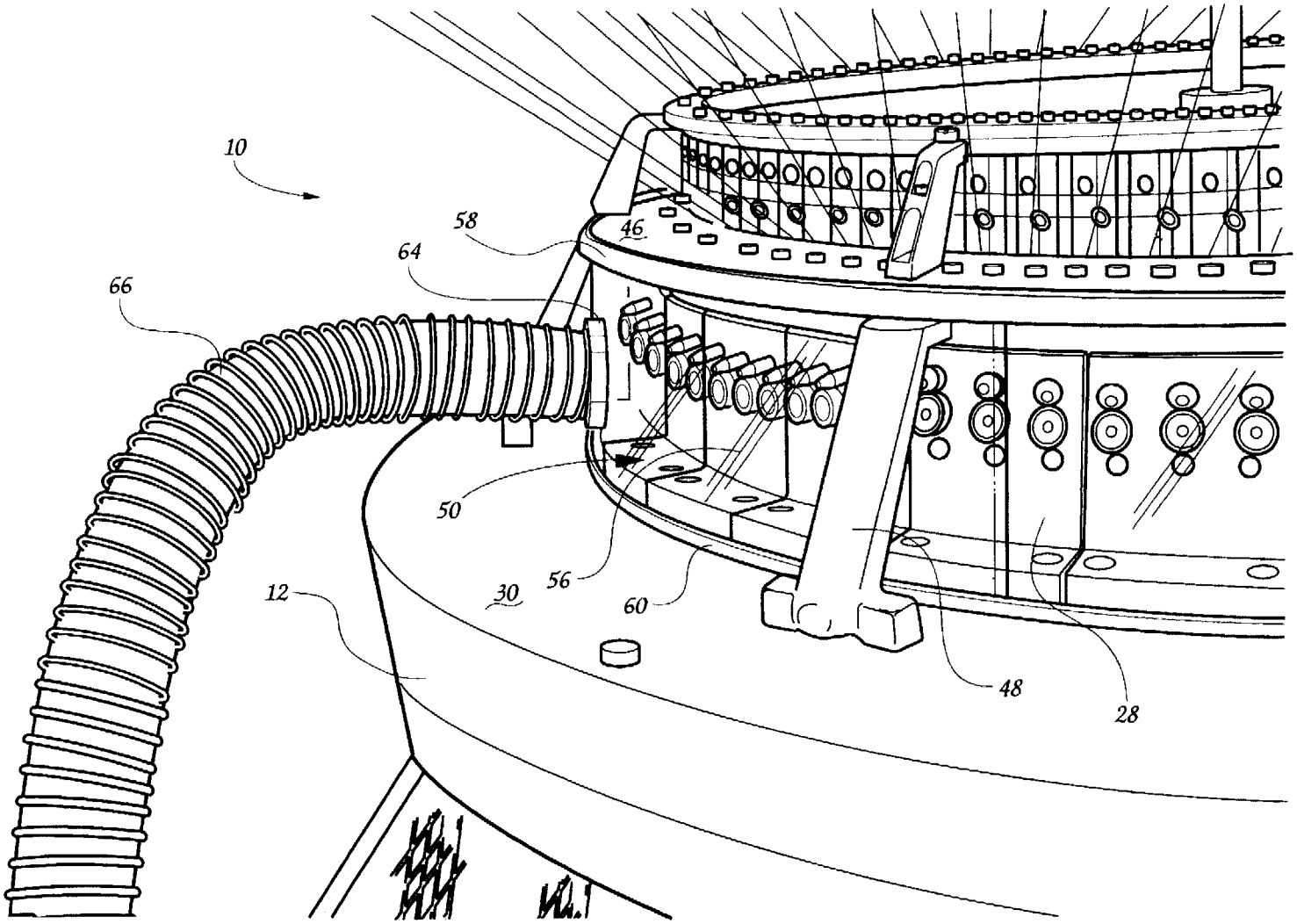
FIG. 1 is a perspective view of the operative knitting components of a generally conventional circular knitting machine which has been retrofitted to incorporate the improvement of the present invention for deterring accumulation of lint, debris and other contaminants onto such components.

Referring now to the accompanying drawings, the improvement of the present invention is depicted in one contemplated embodiment as having been retrofitted to an existing circular knitting machine, generally indicated at 10, of substantially conventional construction. Of course, it is to be understood by those persons skilled in the art that the present invention may be equally adapted for retrofitting to other conventional forms of circular knitting machines and, moreover, may also be well adapted to be incorporated into new machines in the original manufacture thereof. All such variations, applications and potential embodiments of the present invention are contemplated and intended to be within the scope of the present invention.

With specific reference to the circular knitting machine 10 shown in the drawings, the machine basically comprises a stationary floor-standing frame 12 (only the portions of which support the operative knitting components of the machine being shown) on which a needle cylinder 14 and a dial 16 (see FIG. 2) are supported for driven rotation to perform a conventional circular knitting operation.

Figure 2:
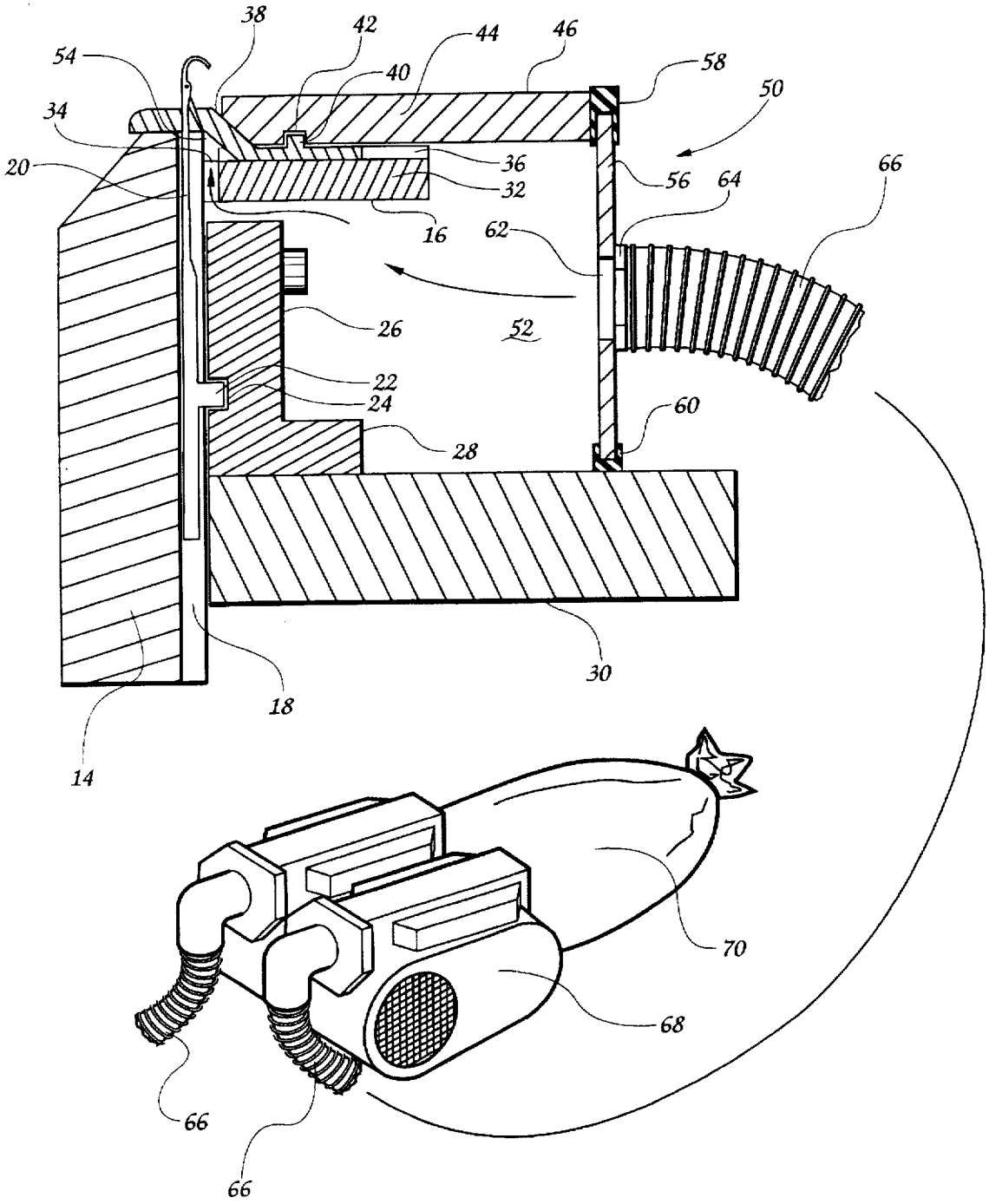
FIG. 2 is a vertical cross-sectional view taken through the knitting components of the machine of FIG. 1 along line 2—2 thereof.

As is conventional, the needle cylinder 14 is formed with a plurality of axial needle slots 18 in equally spaced side-by-side parallel relation about the entire outwardly facing cylindrical surface of the cylinder 14. Knitting needles 20, typically latch-type needles as shown in FIG. 2, are fitted slidably in the needle slots 18 for vertical reciprocation during the rotation of the cylinder 18. To control such needle reciprocation, the needles 20 are formed with control butts 22 which extend radially outwardly from the cylinder slots 18 and are guided within an annular trackway 24 defined by needle control cams 26 mounted on a repeating series of cam support blocks 28 mounted on a horizontal frame plate 30 of the machine frame 12 in closely spaced encircling relation to the needle cylinder 14.

As is also conventional, the dial 16 comprises a ring-like circular plate 32 rigidly mounted concentrically about the cylinder 14 at a close radially outward spacing thereto by a plurality of connecting bars 34 affixed to the cylinder 14 between adjacent slots 18 thereof at annular spacings about the cylinder 14 and extending therefrom radially outwardly to the dial 16. In this manner, the cylinder 14 and the dial 16 are rotated unitarily by the cylinder drive (not shown). Similarly to the cylinder 14, the upper radially extending surface of the dial 16 is formed with a plurality of slots 36 formed at equal spacings about the entire annular extent of the dial surface in radial orientation with respect to the cylinder 14, each dial slot 36 being located intermediate an adjacent pair of the cylinder slots 18. A corresponding plurality of sinkers 38 (or another conventional form of dial-mounted knitting elements) are slidably supported in the dial slots 36 for knitting reciprocation radially toward and away from the cylinder 14 in cooperation with the reciprocating needles 20 of the cylinder 14. For control of the radial reciprocation of the sinkers 38, the shank of each sinker 38 is formed with an upwardly projecting control butt 40 which follows a trackway 42 defined by a plurality of dial cams 44 supported in a circular arrangement by a circular ring-like plate 46, sometimes commonly referred to as the sinker cam ring, supported as part of the machine frame 12 on a series of support legs 48 extending upwardly from the horizontal frame plate 30 to support the plate 46 in generally parallel vertically spaced relation to the frame plate 30. In this disposition, the circular plate 46 overlies the dial 16, with the dial cams 44 facing downwardly to act on the control butts 40 of the sinkers 38.

As will thus be understood, the cylinder needles 20 are continuously reciprocated upwardly and downwardly within their respective cylinder slots 18, while similarly the dial sinkers 38 are continuously reciprocated radially inwardly and outwardly within their respective dial slots 36, under the influence of the cylinder and dial cams 26,44 as the cylinder and dial 14,16 are unitarily rotated by the cylinder drive, whereby the needles 20 and sinkers 38 repetitively perform a cooperative knitting action on yarns Y (FIG. 1) fed to the needles 20. The tubular knitted fabric (not shown) thusly produced is withdrawn downwardly through the interior of the cylinder 14 and wound in roll form on a take-up mechanism (also not shown) supported therebelow.

As thus far described, the individual components and operation of the knitting machine 10 are essentially conventional. Those persons skilled in the art will recognize that the cylinder 14 and the dial 16, particularly their respective needle and sinker slots 18,36, are particularly exposed and subject to the settlement and accumulation thereon of lint, dust, debris, contaminants and the like, both carried airborne in the ambient environment around the knitting machine as a result of having been liberated during the traveling movement and handling of the constituent yarns being knitted and also liberated from the yarns at the precise location and as a result of the knitting manipulation performed on the yarns by the actions of the needles and sinkers. As already discussed above, such debris settling within the cylinder and dial slots 18,36 contributes substantially to the increase of friction generated by the continuous reciprocation of the needles 20 and sinkers 38 within the slots 18,36 and accelerates dramatically the wearing and ultimate failure of such knitting elements.

In accordance with the present invention, this problem is addressed and substantially avoided by enclosing the area between the two horizontal frame plates 30,46 by an annular wall arrangement, generally indicated at 50, radially outwardly thereof so as to define an annular air chamber 52 which can be pressurized to cause an annular airstream to be continuously emitted upwardly through the spacing 54 between the cylinder 14 and the dial 16 to prevent dust, debris, lint and contaminants from settling onto the knitting components in this area.

More particularly, the wall arrangement 50 basically comprises a series of curved plates 56 supported in vertical disposition between an annular channel element 58 mounted to the outward edge of the circular frame plate 46 and a corresponding annular channel element 60 mounted directly therebelow on the upward surface of the frame plate 30. The adjacent end edges of the curved plates 56 are partially overlapped with one another (see FIG. 1) so that the curved plates 56 collectively serve to define a continuous annular wall enclosing the annular chamber 52 between the plates 56, the needle cam support blocks 28 and the two frame plates 30,46. By utilizing individual overlapping plates 56, the wall arrangement 50 advantageously enables essentially any one or more of the individual plates 56 to be removed if and as necessary to perform service on the operational elements enclosed within the air chamber 52.

At least one curved plate 56, and preferably two or more annularly spaced ones of the curved plates 56, are formed therethrough with a circular air passageway 62 in which a fitting 64 is fixed to communicate the passageway and the interior of the air chamber 52 with a flexible air supply hose 66 connected to the fitting 64. The air supply hose 66 is connected to a source of clean pressurized air, which can be generated and supplied by any of various possible conventional means. By way of example but without limitation, the air supply hose or hoses 66 can be connected to a centrifugal air pump 68 (FIG. 2) situated adjacent the circular knitting machine so as to draw ambient air from the area surrounding the knitting machine 10 and pump the air under pressure through the hose or hoses 66 and into the air chamber 52. In such embodiment, it is highly preferred, if not nearly essential, that the intake to the centrifugal air pump 68 be equipped with a filter 70 so as to remove airborne lint, dust, debris and contaminants from the air entering the pump. In the preferred embodiment, at least two air supply hoses 66 are connected to the pump 68, with the two hoses 66 in turn being connected to curved plates 56 at diametrically opposite sides of the circular knitting machine 10 so as to achieve a substantially uniform pressurization about the entire annular extent of the chamber 52.

The operation and advantages of the present invention will thus be readily understood. Optimally, the centrifugal air pump 68 is energized continuously throughout the entire operation of the circular knitting machine. Hence, the annular air chamber 52 remains continuously pressurized, with the pressurized air delivered by the pump 68 having no means of escape from the air chamber 52 other than upwardly through the narrow annular spacing between the needle cylinder 14 and the dial 16, as signified in FIG. 2 by the directional arrows A. As the annular airstream A escapes upwardly through the narrow spacing 54, the force of the airstream 54 is sufficient to blow any airborne lint, debris, contaminants and the like away from the knitting area of the interacting needles and sinkers 20,38 and thereby prevent such materials from settling within the cylinder and dial slots 18,36 or otherwise on the cylinder 14 and dial 16. At the same time, as the escaping airstream A passes through the knitting area, the airstream serves to carry away any lint, debris, contaminants and the like liberated from the yarns by the knitting action of the needles and sinkers, thereby additionally minimizing any potential settlement and accumulation of these materials into the cylinder and dial slots. An attendant advantage is that the airstream assists in cooling the cylinder and dial slots and the knitting elements, thereby improving lubrication and prolonging the life of the knitting elements.

Apart from the advantage of limiting debris accumulation in the critical knitting area of the knitting machine, the present invention also achieves several other attendant advantages. First, with lint and debris accumulation in the cylinder slots being substantially reduced, if not largely eliminated, the need to periodically flush the needle slots with lubricating oil, as is considered necessary under conventional wisdom, is significantly reduced and it is contemplated under many circumstances can be eliminated. Hence, the capital expenditure of equipping circular knitting machines with flushing devices can be saved and the continuing expense of purchasing flushing oil can be likewise avoided. While it will continue to be desirable to utilize oiling devices for purposes of lubricating the needle and dial slots, the volume of oil required can be limited to only that amount necessary to achieve lubrication rather than the significantly greater amount necessary to perform a flushing operation. Overall, the present invention improves the cleanliness and operation of a circular knitting machine while at the same time reducing the capital and operating expenditures associated with such machines.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a circular knitting machine having a stationary frame supporting a cylinder and a concentric dial radially outwardly of the cylinder with an annular spacing therebetween for unitary rotation of the cylinder and dial relative to the frame to perform fabric knitting operations, the improvement comprising means mounted to the frame for defining an air chamber spanning between the cylinder and the dial in communication with the annular spacing therebetween and means for delivering a pressurized airstream into the chamber and outwardly therefrom through the annular spacing to deter accumulation of lint and debris on the cylinder and the dial in the area of the annular spacing therebetween.

2. The improvement in a circular knitting machine according to claim 1, wherein the air chamber extends annularly about the cylinder and the dial.

3. The improvement in a circular knitting machine according to claim 2, wherein the airstream delivering means is communicated with the chamber at plural annular spacings thereabout.

4. The improvement in a circular knitting machine according to claim 1, wherein the airstream delivering means is operative to deliver a clean airstream generally free of lint and debris.

5. The improvement in a circular knitting machine according to claim 4, wherein the airstream delivering means includes means for filtering lint and debris from the airstream.

6. The improvement in a circular knitting machine according to claim 1, wherein the airstream delivering means is operative to deliver the airstream substantially continuously during operation of the knitting machine.

7. The improvement in a circular knitting machine according to claim 1, wherein the air chamber defining means is openable for access to the cylinder and dial.

8. In a circular knitting machine having a stationary frame supporting an upright needle cylinder and a concentric sinker dial radially outwardly of the cylinder with an annular spacing between the cylinder and the dial for unitary rotation of the cylinder and the dial relative to the frame about a substantially vertical axis to perform fabric knitting operations, the frame having a first annular frame element supporting an annular arrangement of needle cams outwardly about the cylinder and a second annular frame element spaced thereabove supporting an annular arrangement of sinker cams radially outwardly of the cylinder, the improvement comprising means mounted between the first and second annular frame elements for defining an annular air chamber spanning between the cylinder and the dial in substantially continuous communication with the annular spacing therebetween and means for delivering a substantially continuous pressurized airstream into the chamber and upwardly therefrom through the annular spacing to deter accumulation of lint and debris on the cylinder and the dial in the area of the annular spacing therebetween.

9. The improvement in a circular knitting machine according to claim 8, wherein the airstream delivering means is communicated with the chamber at plural annular spacings thereabout.

10. The improvement in a circular knitting machine according to claim 8, wherein the airstream delivering means is operative to deliver a clean airstream generally free of lint and debris.

11. The improvement in a circular knitting machine according to claim 10, wherein the airstream delivering means includes means for filtering lint and debris from the airstream.

12. The improvement in a circular knitting machine according to claim 8, wherein the air chamber defining means is openable for access to the cylinder and dial.

13. The improvement in a circular knitting machine according to claim 12, wherein the air chamber defining means comprises a series of adjoining wall elements at least some of which are movable to provide access to the cylinder and the dial.

14. In a circular knitting machine having a stationary frame supporting a cylinder for rotation relative to the frame to perform fabric knitting operations, the cylinder carrying a plurality of axially reciprocable needles, the improvement comprising means mounted to the frame for defining an air chamber annularly about the cylinder and an annular opening closely adjacent the cylinder facing axially alongside the needles thereof and means for delivering a pressurized airstream into the chamber and outwardly therefrom through the annular opening to flow closely alongside the needles in the direction of axial reciprocation thereof to deter accumulation of lint and debris on the needle area of the cylinder.

15. The improvement in a circular knitting machine according to claim 14, wherein the airstream delivering means is communicated with the chamber at plural annular spacings thereabout.

16. The improvement in a circular knitting machine according to claim 14, wherein the airstream delivering means is operative to deliver a clean airstream generally free of lint and debris.

17. The improvement in a circular knitting machine according to claim 16, wherein the airstream delivering means includes means for filtering lint and debris from the airstream.

18. The improvement in a circular knitting machine according to claim 14, wherein the airstream delivering means is operative to deliver the airstream substantially continuously during operation of the knitting machine.

19. The improvement in a circular knitting machine according to claim 14, wherein the air chamber defining means is openable for access to the cylinder.

20. In a circular knitting machine having a rotatable cylinder carrying a plurality of axially reciprocable knitting instruments for performing fabric knitting operations, the improvement comprising means for creating an annular airstream flowing closely adjacent the cylinder in the direction of axial reciprocation of the knitting instruments to deter accumulation of lint and debris on the cylinder.

21. The improvement in a circular knitting machine according to claim 20, wherein the airstream creating means includes means for directing the airstream axially relative to the cylinder.

22. In a circular knitting machine having a stationary frame supporting a circular arrangement of knitting instruments for rotation relative to the frame and for individual movement of the knitting instruments in a common direction of knitting motion to perform fabric knitting operations, the improvement comprising means mounted to the frame for defining a substantially enclosed air chamber annularly about the circular arrangement of knitting instruments and an annular opening closely adjacent and facing in the direction of knitting motion of the knitting instruments and means for delivering a pressurized airstream into the chamber and outwardly therefrom through the annular opening to flow closely alongside the knitting instruments in the direction of knitting motion thereof to deter accumulation of lint and debris on the circular arrangement and the knitting instruments thereof.

23. The improvement in a circular knitting machine according to claim 22, wherein the airstream delivering means is communicated with the chamber at plural annular spacings thereabout.

24. The improvement in a circular knitting machine according to claim 22, wherein the airstream delivering means is operative to deliver a clean airstream generally free of lint and debris.

25. The improvement in a circular knitting machine according to claim 24, wherein the airstream delivering means includes means for filtering lint and debris from the airstream.

26. The improvement in a circular knitting machine according to claim 22, wherein the airstream delivering means is operative to deliver the airstream substantially continuously during operation of the knitting machine.

27. The improvement in a circular knitting machine according to claim 22, wherein the air chamber defining means is openable for access to the circular arrangement of knitting instruments.

28. In a knitting machine having an arrangement of plural knitting instruments disposed in adjacent side-by-side relation for cooperative movement in a common direction of knitting motion to perform fabric knitting operations, the improvement comprising means for defining a substantially enclosed air chamber alongside the arrangement of plural knitting instruments and an elongate opening closely adjacent the knitting instruments and means for delivering a pressurized airstream into the chamber and outwardly therefrom through the elongate opening, the elongate opening being oriented to face in the direction of knitting motion of the knitting instruments to direct the airstream closely alongside the knitting instruments in the direction of knitting motion thereof, for deterring accumulation of lint and debris on the arrangement and the knitting instruments thereof.

29. The improvement in a knitting machine according to claim 28, wherein the airstream delivering means includes means for filtering lint and debris from the airstream.

30. A knitting machine according to claim 28, wherein the airstream delivering means is operative to deliver the airstream substantially continuously during operation of the knitting machine.

31. In a method of circular knitting by rotating a circular arrangement of knitting instruments while individually manipulating the knitting instruments in a common direction of knitting motion to perform fabric knitting operations, the improvement comprising substantially enclosing an air chamber annularly about the circular arrangement of knitting instruments, delivering a pressurized airstream into the chamber, and emitting the airstream outwardly from the chamber along substantially the entire annular extent closely adjacent the knitting instruments to flow closely alongside the knitting instruments in the direction of knitting motion thereof to deter accumulation of lint and debris on the circular arrangement and the knitting instruments thereof.

32. The improvement in a circular knitting method according to claim 31 and further comprising filtering lint and debris from the airstream.

33. The improvement in a circular knitting method according to claim 31 and further comprising delivering the airstream into the chamber continuously during operation of the knitting machine.

34. The improvement in a circular knitting method according to claim 31 and further comprising disposing the knitting instruments in a cylindrical arrangement and manipulating the knitting instruments axially relative to their cylindrical arrangement, the emitting of the airstream comprising directing the airstream to flow axially alongside the knitting instruments.

35. In a method of knitting by providing a plurality of knitting instruments arranged in adjacent side-by-side relation and manipulating the knitting instruments cooperatively in a common direction of knitting motion to perform fabric knitting operations, the improvement comprising substantially enclosing an air chamber alongside the plural knitting instruments, delivering a pressurized airstream into the chamber, and emitting the airstream outwardly from the chamber along substantially the entire extent closely adjacent the knitting instruments to flow closely alongside the knitting instruments in the common direction of motion thereof for deterring accumulation of lint and debris on the knitting instruments.

36. The improvement in a knitting method according to claim 35 and further comprising filtering lint and debris from the airstream.

37. The improvement in a knitting method according to claim 35 and further comprising delivering the airstream into the chamber continuously during operation of the knitting machine.

38. In a circular knitting machine having a needle cylinder carrying a plurality of axially movable needles about the outward circumferential periphery of the cylinder and a frame supporting the cylinder in upright disposition for rotation to perform fabric knitting operations, the improvement comprising means mounted on the frame for defining an annular air chamber outwardly about the cylinder and an annular opening facing generally axially upwardly adjacent to the needles of the cylinder, and means for delivering a generally continuous pressurized airstream into the chamber and upwardly therefrom through the annular opening to flow alongside the needles in the direction of axial movement thereof to deter accumulation of lint and debris on the cylinder and needles thereof.

39. A circular knitting machine according to claim 38, wherein the airstream delivering means is communicated with the chamber at plural annular spacing thereabout.

40. A circular knitting machine according to claim 39, wherein the airstream delivering means includes means for filtering lint and debris from the airstream.

41. In a circular knitting machine having a plurality of knitting needles mounted for vertical reciprocation in a rotating cylinder and a plurality of sinkers mounted radially outwardly about the cylinder for horizontal movement in cooperation with the needles during knitting of yarn into fabric, the juncture of said needles and sinkers forming an annular space therebetween:

means for maintaining the needles and sinkers substantially clean from waste during knitting comprising:

an air chamber extending around the needle cylinder and beneath the sinkers;

said air chamber having an opening extending annularly around the cylinder facing axially upwardly adjacent the juncture of the needles and sinkers; and means for introducing air under pressure into the air chamber to cause it to flow axially alongside the needles upwardly and outwardly through the annular space between the needles and sinkers during knitting.

* * * * *